US005897414A

United States Patent [19]

Bergeron et al.

[11] Patent Number: 5,897,414

[45] Date of Patent: Apr. 27, 1999

[54] TECHNIQUE FOR INCREASING MANUFACTURING YIELD OF MATRIX-ADDRESSABLE DEVICE

[75] Inventors: David L. Bergeron, San Jose; Christopher J. Curtin, Los Altos Hills; John M. Macaulay, Palo Alto, all of Calif.

[73] Assignee: Candescent Technologies Corporation, San Jose, Calif.

[21] Appl. No.: 08/547,181

[22] Filed: Oct. 24, 1995

[51] Int. Cl.[6] ..... H01J 9/42

[52] U.S. Cl. ..... 445/3; 445/24

[58] Field of Search ..... 445/3, 50, 24

[56] References Cited

U.S. PATENT DOCUMENTS

| | | | |
|---|---|---|---|
| 3,940,740 | 2/1976 | Coontz | 438/130 |
| 4,820,222 | 4/1989 | Holmberg et al. . | |
| 4,840,459 | 6/1989 | Strong | 445/3 |
| 5,162,931 | 11/1992 | Holmberg . | |

OTHER PUBLICATIONS

Mueller, "Tiling Thin–Film Electroluminescent Displays", *SID 91 Digest,* 1991, pp. 567–570.

*Primary Examiner*—Kenneth J. Ramsey

*Attorney, Agent, or Firm*—Skjerven, Morrill, MacPherson, Franklin & Friel LLP; Ronald J. Meetin

[57] ABSTRACT

The yield in manufacturing matrix-addressable devices, particularly flat-panel CRT displays, is increased by a technique in which a determination is first made that a defect exists in part of a first matrix-addressable plate structure (20) of a unitary first active area (32). This typically entails testing a group of the first plate structures to determine whether any of them are defective. The defective part or parts of each defective first plate structure are also identified. At least one non-defective first plate structure normally is subsequently converted into a first matrix-addressable device of the first active area. For a defective first plate structure identified in the testing, the defective part of the structure is removed in such a way that the remainder of the structure forms a second matrix-addressable plate structure (84) of a second active area (32A) smaller than the first active area. The second plate structure is normally tested and, if non-defective, is subsequently converted into a second matrix-addressable device.

24 Claims, 7 Drawing Sheets

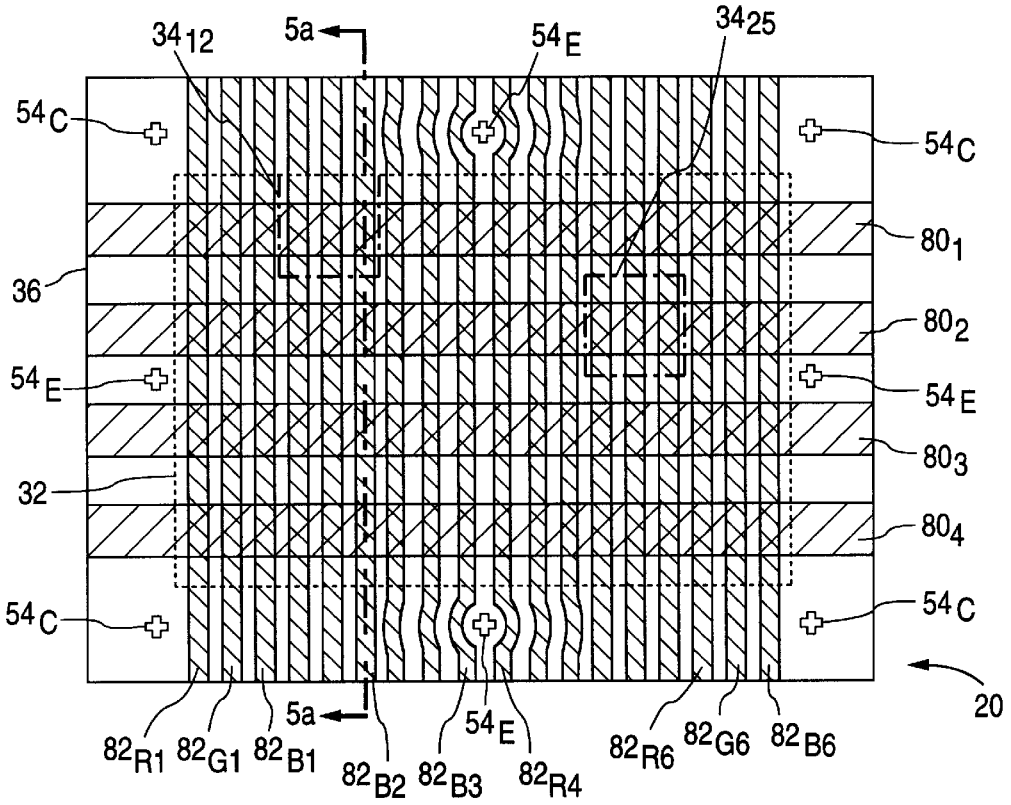
FIG. 3
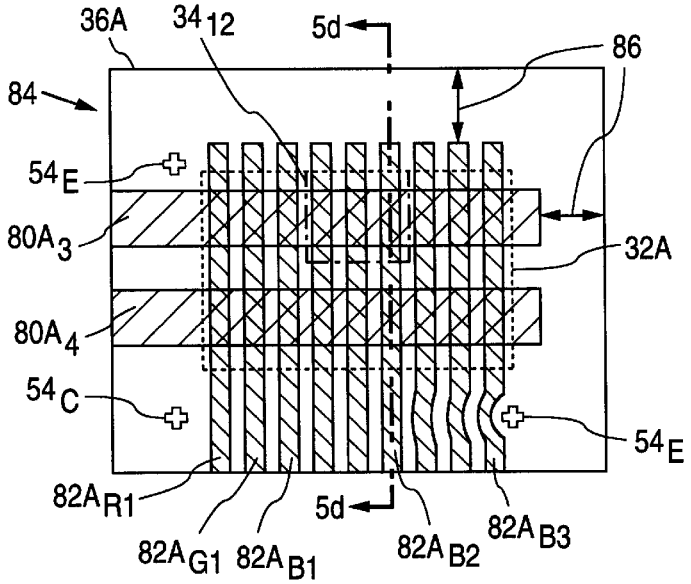
FIG. 4.1

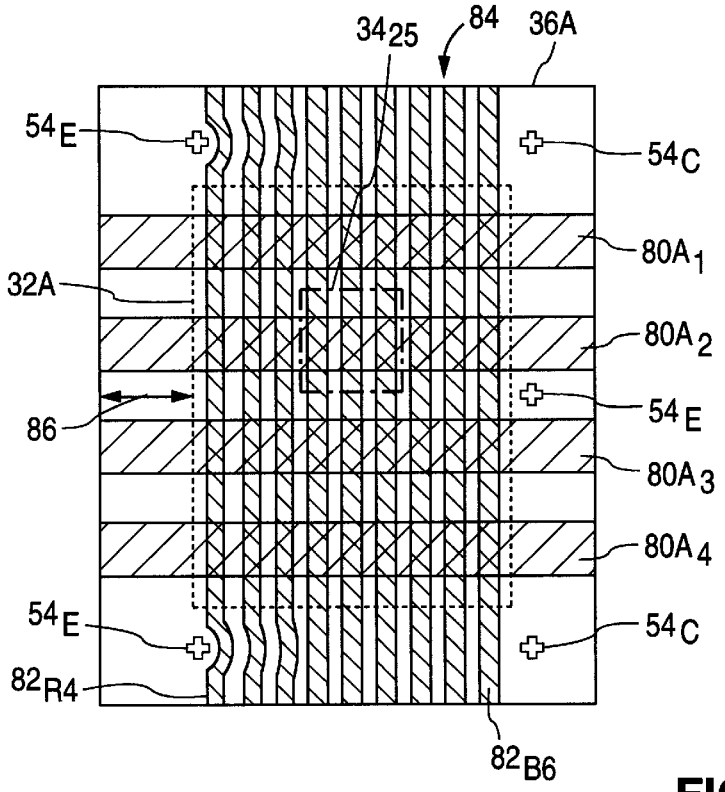
FIG. 4.2
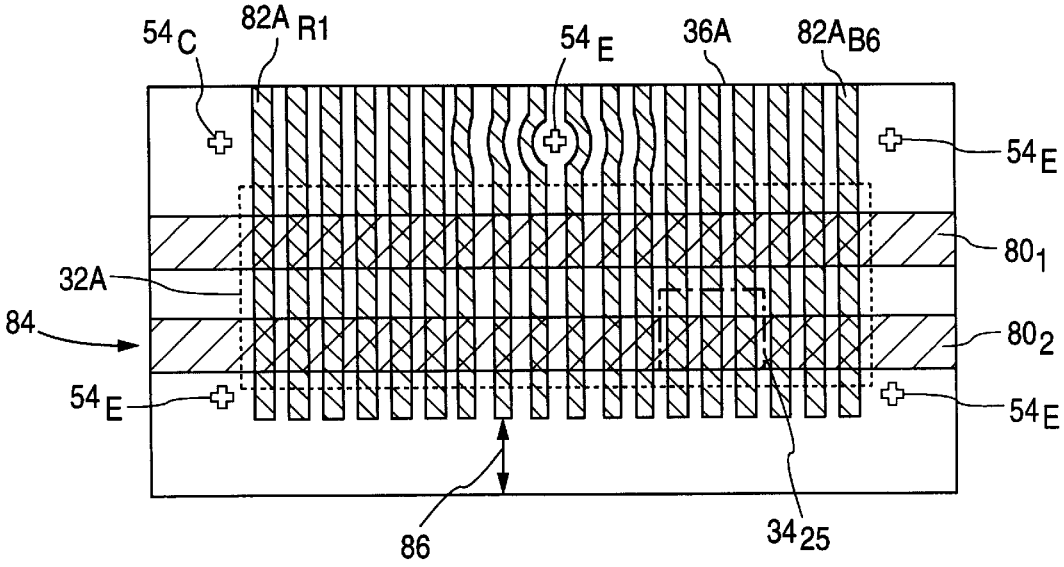
FIG. 4.3

TECHNIQUE FOR INCREASING MANUFACTURING YIELD OF MATRIX-ADDRESSABLE DEVICE

FIELD OF USE

This invention relates to matrix-addressable devices, especially those of the flat-panel cathode-ray tube (CRT) type. This invention also relates to the fabrication of matrix-addressable devices.

BACKGROUND

A matrix-addressable device is an electronic device containing a group of cells addressed through electrodes arranged in a multi-dimensional matrix. For example, in a two-dimensional matrix-addressable device, a set of first electrodes typically extend in one direction. A set of second electrodes extend above the first electrodes in another (often perpendicular) direction so that the second electrodes cross the first electrodes. The cell locations are defined at the crossing points of the two sets of electrodes. Each cell is addressed through an appropriate one of first electrodes and an appropriate one of the second electrodes.

There are many types of matrix-addressable devices. One type is matrix-addressable sensors. Another type is flat-panel displays in which the display thickness is considerably less than the display length and width. A flat-panel CRT display is one example of a flat-panel display. Other examples include liquid-crystal, electroluminescent, plasma, electrochromic, and electrophoretic displays.

One problem in manufacturing generally flat matrix-addressable devices is that the yield of good devices is inevitably less than 100%. If one picture element ("pixel") is defective in a flat-panel display, the entire display is defective. A lower device yield results in an economic loss. Accordingly, an important objective in fabricating matrix-addressable devices is to increase the manufacturing yield, especially when the devices are being fabricated on a volume-production scale.

Various techniques have been considered for increasing the manufacturing yield of matrix-addressable devices. One technique is to provide a matrix-addressable device with redundant (or back-up) components. Holmberg et al, U.S. Pat. No. 4,820,222, discloses how redundant pixel components are introduced into a flat-panel CRT display. Each pixel in Holmberg et al basically consists of multiple subpixels. The failure of one subpixel in any pixel of the flat-panel display of Holmberg et al generally does not cause the entire display to be defective provided that at least one other subpixel in the same pixel is good. The manufacturing yield is thereby raised.

Unfortunately, providing a matrix-addressable display with redundant pixels is disadvantageous for a number of reasons. In applications where the area occupied by a pixel must fall within certain dimensional constraints, the size of each of the primary pixel components (i.e., the pixel components which would be present in the absence of the redundant components) must be reduced in order to enable each pair of primary and redundant components to be created in the same area otherwise occupied only by a primary pixel component. This can degrade the operational performance of the primary pixel components. Also, the complexity is increased, thereby reducing the reliability. It is desirable to increase the yield in manufacturing matrix-addressable devices without incurring a loss in device performance or reliability.

GENERAL DISCLOSURE OF THE INVENTION

The present invention furnishes a technique for increasing the yield in fabricating matrix-addressable devices, particularly flat-panel CRT displays, by taking advantage of the fact that a manufacturer of matrix-addressable devices typically produces devices of different active area such that the active area of one matrix-addressable device fits into the active area of another matrix-addressable device. The central theme of the present yield-increasing technique is to create matrix-addressable devices of a certain specified size from otherwise defective device components intended for matrix-addressable devices generally of larger size.

Specifically, a determination is first made that a defect exists in part of a first matrix-addressable plate structure of a unitary first active area. This typically entails providing a plurality of first matrix-addressable plate structures of the first active area and then testing the first plate structures to determine whether any of them are defective. During the testing, the defective part or parts of each defective first plate structure are also identified. At least one non-defective first plate structure normally is subsequently converted into a first matrix-addressable device of the first active area.

For a defective first plate structure so identified, the defective part of the structure is removed, along with selected adjoining material of the structure, in such a way that the remainder of the structure forms a second matrix-addressable plate structure of a second active area smaller than the first active area. When a group of the second plate structures are created from the first plate structures in this way, the second plate structures are normally tested to determine whether any of them is defective. At least one non-defective second plate structure is then converted into a second matrix-addressable device.

Each first plate structure preferably contains a set of first electrodes extending over an electrically insulating plate in a first direction. An electrically insulating layer is situated over the first electrodes. A set of second electrodes extends over the insulating layer in a second direction different from the first direction such that the second electrodes cross the first electrodes.

The portions of the first and second electrodes that remain after removal of defective portion of the first plate structure serve as electrodes in the second plate structure. For this purpose, the first plate structure is typically configured so that both ends of each electrode in at least one set, preferably both sets, of electrodes are externally accessible. By appropriately choosing the portion of the first plate structure used to create the second plate structure, the remaining portions of the first and second electrodes are externally accessible in the second plate structure.

The second plate structure can be created from the first plate structure in various ways. When the first plate structure is generally rectangular, the second plate structure can be formed so as to include one or two corners of the first plate structure. Alternatively, if the two sets of electrodes are contacted through conductively filled vias provided in the plate underlying the electrodes, the second plate structure can consist of an interior portion of the first plate structure—i.e., a portion of the first plate structure spaced apart from its lateral perimeter. Also, two or more of the second plate structures can be joined together (tiled) to form a plate structure for a second matrix-addressable device whose active area is greater than the second active area.

By creating matrix-addressable devices using plate structures from which the defective portions are removed, wastage is avoided. The overall manufacturing yield of good matrix-addressable devices is increased.

Importantly, the matrix-addressable devices fabricated according to the technique of the invention perform substantially the same as matrix-addressable devices created from plate structures that are initially formed to be of the desired active area. No performance or reliability loss occurs in using the present yield-enhancing technique. The invention thus provides a significant improvement over the prior art.

BRIEF DESCRIPTION OF THE DRAWINGS

FIG. 3 is a simplified layout view of part of a baseplate structure in accordance with the invention.

FIGS. 4.1, 4.2, and 4.3 are simplified layout views of parts of three different baseplate structures creatable from the baseplate structure of FIG. 3 in accordance with the invention.

Figure 1:
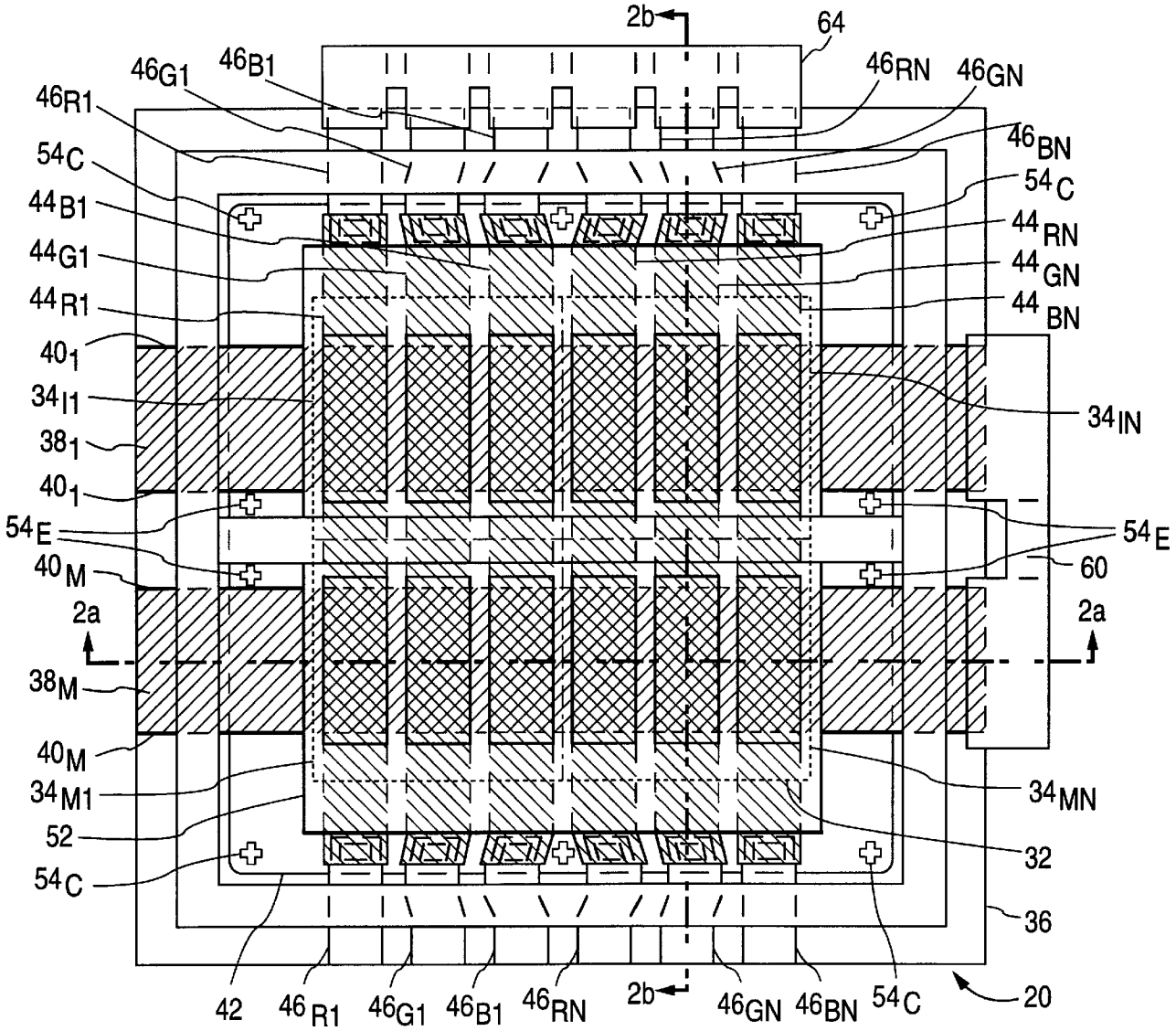
FIG. 1 is a layout view of a simplified example of an inventive baseplate structure for a matrix-addressable flat-panel CRT display in accordance with the invention.

Like reference symbols are employed in the drawings and in the description of the preferred embodiments to represent the same or very similar item or items. To help distinguish elements in the layout views of FIGS. 2, 3, and 4.1–4.3, the row and column electrodes in FIGS. 2, 3, and 4.1–4.3 are drawn with the same shadings respectively used for the row and column electrodes in the cross-sectional views of FIGS. 2 and 5.

DESCRIPTION OF THE PREFERRED EMBODIMENTS

Referring to the drawings, FIG. 1 illustrates a simplified example of one of a group of substantially identical matrix-addressable plate structures 20 configured according to the invention. Each of plate structures 20 is intended for use as a baseplate (or backplate) structure in a matrix-addressable flat-panel CRT display of a specified active area. An image is visible on the active display area during display operation. Each plate structure 20 has its own active area corresponding to the active display area.

Plate structures 20 are typically fabricated according to a volume-production manufacturing technique. Subsequent to fabrication, structures 20 is tested to determine whether any of them are defective. The defective part or parts of each defective plate structure are identified during the testing, at least when a defect exists in the active area of the plate structure.

Figure 2A:
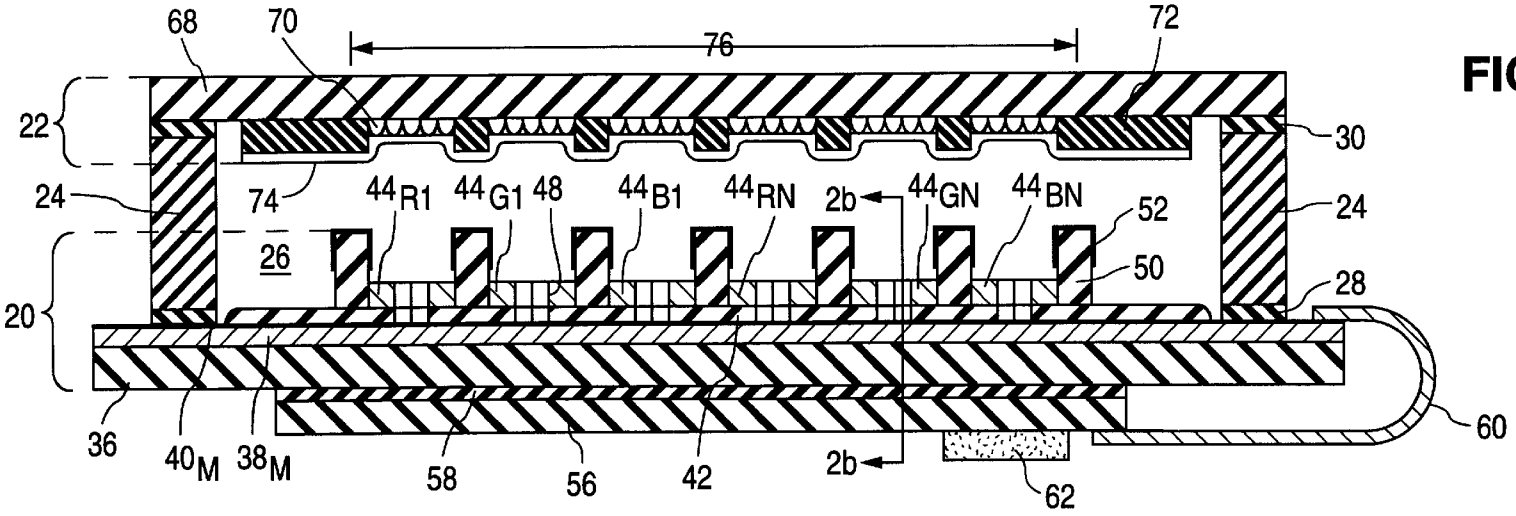
FIGS. 2*a* and 2*b* are cross-sectional views of a matrix-addressable flat-panel CRT display whose baseplate structure is shown in FIG. 1. The cross sections of FIGS. 2*a* and 2*b* are respectively taken through planes 2*a*—2*a* and 2*b*—2*b* in FIG. 1.
Figure 2B:
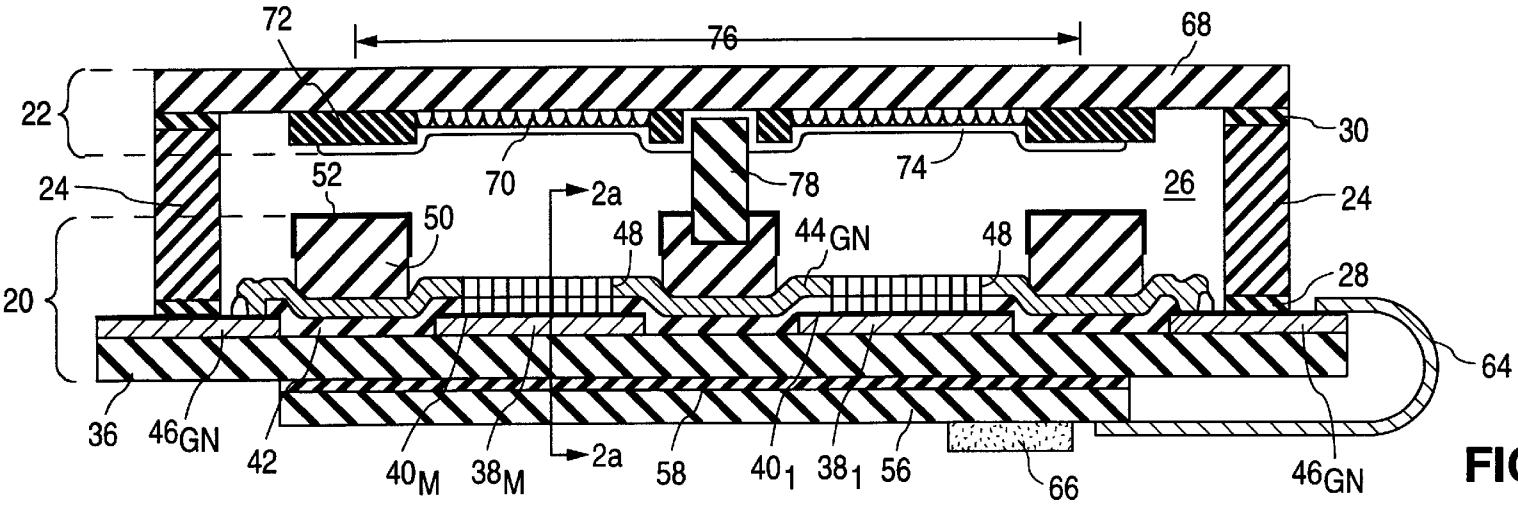

At least one of the non-defective plate structures, as determined by the post-fabrication testing, is incorporated into a matrix-addressable flat-panel CRT display of the specified active area. FIGS. 2*a* and 2*b* (collectively "FIG. 2") depict how such a non-defective baseplate structure 20 is sealed to a faceplate structure 22 through a perimeter wall 24 to form a sealed enclosure 26 in the final flat-panel CRT display. Items 28 and 30 in FIG. 2 indicate sealing glass at the edges of perimeter wall 24 along structures 20 and 22. The pressure in sealed enclosure 26 is typically set at a vacuum level—e.g., $10^{-7}$ torr or lower—by removing air through a pump port (not shown) situated near wall 24.

Returning to baseplate structure 20, it has a unitary active area 32 indicated by dotted lines in FIG. 1. As used here in describing the active area of a plate structure, "unitary" means that the active area is a single continuous area. In particular, a unitary active area is not divided into multiple areas laterally separated from one another by scribe lines or other such non-active regions.

Active area 32 in baseplate structure 20 is formed with a two-dimensional matrix of adjoining square pixel cells $\mathbf{34}_{ij}$ arranged in M rows and N columns. Each pixel row i consists of N pixels $\mathbf{34}_{i1}$–$\mathbf{34}_{iN}$, where i runs from 1 to M. Each pixel column consists of M pixels $\mathbf{34}_{ij}$–$\mathbf{34}_{Mj}$, where j runs from 1 to N. The lateral extent of each square pixel $\mathbf{34}_j$ in FIG. 1 is indicated by the dot-and-dash line in combination, along the perimeter of active area 32, with the dotted lines representing area 32.

To demonstrate the arrangement of plate structure 20 without overcrowding the drawing, FIG. 1 illustrates only four pixels $\mathbf{34}_{ij}$ (simply "34"). The total number M of rows and the total number N of columns are both two in the illustrated example. However, the number MN of cells 34 is normally much higher than four. Depending on the desired pixel density, the desired value of active area 32, and the desired active-area aspect ratio (length/width), the number MN of pixels 34 typically varies from a minimum of several tens of thousands to several orders of magnitude higher than the minimum number. In a typical example, the number M of rows is 480—500 while the number N of columns is 640–660 so that the total number MN of pixels 34 is somewhat greater than 300,000. In another example, there are 768 rows and 1,024 columns for a total of slightly under 800,000 pixels 34.

Baseplate structure 20 is configured so that a portion of it can be employed in accordance with the teachings of the invention to form a baseplate structure for a matrix-addressable flat-panel CRT display whose active is smaller than active area 32. Baseplate structure 20 is normally utilized in this manner when one or more defects exist in active area 32 provided that each defect is located outside a portion of active area 32 suitable for the active area of the CRT display of smaller active area. The baseplate structure for the CRT display of smaller active area is then created from the non-defective part of baseplate structure 20.

Also, when two or more of baseplate structures 20 are defective, non-defective portions of the defective baseplate structures can be joined together to form a baseplate structure for a matrix-addressable flat-panel CRT display whose active area is greater than that of the CRT display of smaller active area. In particular, the active area of a baseplate structure created by tiling non-defective portions of two or more baseplate structures 20 can equal or exceed the area occupied by active area 32.

Baseplate structure 20 is created from a rectangular electrically insulating baseplate 36 having two opposing flat surfaces referred to as the exterior baseplate surface (lower surface in FIG. 2) and the interior baseplate surface (the upper surface in FIG. 2). M laterally separated metallic row (emitter) electrodes $\mathbf{38}_1$–$\mathbf{38}_M$ (collectively "38") extend across baseplate 36 from one edge to the opposite edge in the row direction—i.e., horizontally in FIG. 1. As indicated in FIG. 2, row electrodes 38 are situated on the interior baseplate surface. Each row electrode $\mathbf{38}_i$ provides row address control over pixels $\mathbf{34}_{i1}$–$\mathbf{34}_{iN}$ in corresponding row i.

M electrically resistive coatings $\mathbf{40}_1$–$\mathbf{40}_M$ (collectively "40") respectively overlie row electrodes $\mathbf{38}_1$–$\mathbf{38}_M$. Resistive coatings 40 may be considered part of row electrodes 38. Sealing layer 28 contacts resistive coatings 40.

Each of row electrodes 38 is externally accessible at both ends. As used here, an "externally accessible" electrical conductor of a matrix-addressable device is an electrical conductor to which electrical connection can directly be made from outside the device. For example, as is the case with row electrodes 38, an electrical conductor of a matrix-addressable device is externally accessible when the conductor itself extends to the outside surface of the device. Alternatively, an electrical conductor of a matrix-addressable device is externally accessible when the conductor connects directly or through one or more intermediate electrically conductive components to another electrically conductive component that extends to the outside surface of the device.

To provide or improve the electrical connection from outside a matrix-addressable device to an externally accessible electric conductor such as one of row electrodes 38, it may sometimes be necessary or desirable to remove an insulating or resistive coating from electrically conductive material to which external connection is to be made along the outside surface of the device. For example, in the CRT display of FIGS. 1 and 2, resistive coatings 40 are typically removed from the locations where external electrical connections are made to electrodes 38. Provided that such coatings can be readily removed after device fabrication is otherwise substantially complete, the presence of the coatings does not impair characterization of the electrical conductors as being externally accessible.

An electrically insulating inter-electrode layer 42 lies on top of resistive coatings 40 and the adjoining parts of baseplate 36 within enclosure 26. 3N laterally separated metallic column (gate) electrodes $\mathbf{44}_{R1}$, $\mathbf{44}_{G1}$, $\mathbf{44}_{B1}$–$\mathbf{44}_{RN}$, $\mathbf{44}_{GN}$, and $\mathbf{44}_{BN}$ (collectively "44") are situated on top of insulating layer 42 within enclosure 26. Column electrodes 44 extend above row electrodes 38 in the column direction—i.e., vertically in FIG. 1. Each trio of column electrodes $\mathbf{44}_{Rj}$, $\mathbf{44}_{Gj}$, and $\mathbf{44}_{Bj}$ provides column address control over pixels $\mathbf{34}_{1j}$–$\mathbf{34}_{Mj}$ in corresponding column j.

Each end of each column electrode $\mathbf{44}_{Rj}$, $\mathbf{44}_{Gj}$, or $\mathbf{44}_{Bj}$ is connected to a corresponding metallic column electrode extension $\mathbf{46}_{Rj}$, $\mathbf{46}_{Gj}$, or $\mathbf{64}_{Bj}$ by way of a via in insulating layer 42. Column electrode extensions $\mathbf{46}_{R1}$, $\mathbf{46}_{G1}$, $\mathbf{46}_{B1}$–$\mathbf{46}_{RN}$, $\mathbf{46}_{GN}$, and $\mathbf{46}_{BN}$ (collectively "46") may be considered part of column electrodes 44. Column electrode extensions 46 consists of the same metal (and are formed at the same time) as row electrodes 38.

Electrically resistive coatings (shown in dark lines in FIGS. 1 and 2 but not specifically labelled to avoid overcrowding the figures) overlie column electrode extensions 46. These resistive coatings may be considered part of column electrode extensions 46 and thus part of column electrodes 44. Also, these resistive coatings, which are contacted by sealing layer 28, consist of the same resistive material (and are formed at the same time) as resistive coatings 40.

Column electrode extensions 46 extend to the outside surface of the CRT display. In FIG. 1, half of electrode extensions 46 extend to the upper edge of baseplate 36. The other half of extensions 46 extend to the lower edge of baseplate 36. Accordingly, each of column electrodes 44 is externally accessible at both ends.

At each location where one of column electrodes 44 crosses one of row electrodes 38, a group of electron-emissive elements (electron emitters) 48 extend through corresponding openings in that column electrode 44 and underlying insulating layer 42 to contact resistive coating 40 above crossing row electrode 38. Electron emitters 48 may be configured in various shapes, such as cones and filaments, and thus are shown generally in FIG. 2. Each electron emitter 48 is spaced apart from its column electrode 44. In particular, each electron emitter 48 preferably extends into a corresponding column-electrode (gate) opening centered on, and therefore spaced equidistantly apart from, that emitter 48.

Components 36—48 are all part of baseplate structure 20. In addition, structure 20 contains a matrix of intersecting row and column focusing ridges. The row focusing ridges, which extend in the row direction (horizontally in FIG. 1) are situated on column electrodes 44 to the sides of row electrodes 38. The column focusing ridges, which extend in the column direction (vertically in FIG. 1) are situated on insulating layer 42 generally to the sides of column electrodes 44. The focusing ridges consist of electrically insulating central ridge portions 50 and overlying metallic coatings 52 spaced apart from column electrodes 44.

Four corner fiducials (alignment marks) $\mathbf{54}_C$ are situated on insulating layer 42 outside active area 32 but within enclosure 26 close to the four corners of active area 32. Corner fiducials $\mathbf{54}_C$ are utilized to provide alignment during the fabrication of baseplate structure 20 and during the assembly of faceplate structure 22 to baseplate structure 20. Six additional edge fiducials $\mathbf{54}_E$ are situated on insulating layer 42 outside active area 32 but within enclosure 26 close to the sides of active area 32. Fiducials $\mathbf{54}_c$ and $\mathbf{54}_E$ (collectively "54") consist of the same material (and are formed at the same time) as column electrodes 44.

When a portion of baseplate structure 20 is utilized to form a baseplate structure of smaller active area than active area 32, one or more of edge fiducials $\mathbf{54}_E$ is typically employed to provide alignment during assembly of the resulting smaller baseplate structure to a suitable faceplate structure. Accordingly, edge fiducials $\mathbf{54}_E$ are situated at locations where fiducials would likely be needed (or helpful) to provide alignment for probable portions of baseplate structure 20 used to form a smaller baseplate structure. In the example shown in FIG. 1, some of column electrodes 44 and electrode extensions 46 are bent slightly so as to avoid edges fiducials $\mathbf{54}_E$. Although not shown in FIG. 1, the presence of edge fiducials $\mathbf{54}_E$ also typically causes some of row electrodes 38 to be bent slightly.

In the embodiment depicted in FIG. 2, a printed circuit board ("PCB") 56 is situated along the exterior surface of baseplate 36. PCB 56 is bonded to baseplate 36 by way of bonding material 58.

A row tab connector 60 consisting of at least M electrical conductors connects row electrodes 38 to a printed circuit pattern (not shown) on PCB 56. The printed circuit pattern connects row tab connector 60 to a row driver integrated circuit ("IC") 62 situated on PCB 56. A column tab connector 64 consisting of at least 3N electrical conductors similarly connects column electrodes 44 to a printed circuit pattern (again not shown) on PCB 56. This printed circuit pattern connects column tab connector 64 to a column driver IC 66 situated on PCB 56. In response to external signals, driver ICs 62 and 66 control the voltages on electrodes 38 and 44.

Alternatively, driver ICs 62 and 66 could be respectively situated on tab connectors 60 and 64. Each of tab connectors 60 and 64 may be replaced with two or more tab connectors situated in parallel. Likewise, each of driver ICs 62 and 66 may be replaced with two or more driver ICs.

The voltages on electrodes 38 and 44 can be controlled by a mechanism that does not involve a PCB bonded to the exterior surface of baseplate 36. For example, the electronics for controlling the electrode voltages can be situated on the interior surface of baseplate 36 in the perimeter area outside sealed enclosure 26. The electronics for controlling electrodes 38 and 44 can also be situated on a PCB not bonded to baseplate 36.

Faceplate structure 22 is created from a rectangular electrically insulating transparent faceplate 68 having two flat surfaces referred to as the interior surface (lower surface in FIG. 2) and the exterior surface (upper surface in FIG. 2). A phosphor pattern consisting of 3MN portions 70 is situated on the interior faceplate surface generally across from the locations where column electrodes 44 cross row electrodes 38. An opaque black matrix 72 is situated on the interior faceplate surface in the spaces between phosphor portions 70. An anode formed with a thin light-reflective metallic layer 74 is situated on phosphor portion 70 and black matrix 72 to complete faceplate structure 22.

Arrows 76 in FIG. 2 indicate the active display area on which an image is presented on the exterior surface of faceplate 68 for a viewer to see. Active display area 76 has substantially the same dimensions, and thus occupies substantially the same area, as active baseplate area 32.

A group of internal spacer walls 78, one of which is illustrated in FIG. 2*b*, are situated within enclosure 26 between baseplate structure 20 and faceplate structure 22. Spacer walls 78 help maintain a fixed spacing between structures 20 and 22 along their lateral extents. Spacers 78 also enable the display to withstand external forces exerted on structures 20 and 22. One edge of each spacer wall 78 is situated in a depression formed in a corresponding one of column focusing ridges 50/52. The opposite edge of each spacer wall 78 is situated in a depression in black matrix 72.

In a typical embodiment, each square pixel 34 is 315–320 μm along each side. Row electrodes 38 are approximately 175 μm wide. Column electrodes 44 are approximately 75 μm wide. Focusing ridges 50/52 have a width of 100–130 μm in the row direction and approximately 25 μm in the column direction.

Baseplate 36 typically consists of glass having a thickness of approximately 1.1 mm. Row electrodes 38 and column electrode extensions 46 are formed with nickel over chromium, the nickel/chromium composite having a thickness of approximately 200 nm. Resistive coatings 40 and the resistive coatings overlying electrode extensions 46 consist of silicon carbide or cermet having a thickness of approximately 300 nm. Insulating layer 42 is formed with silicon oxide having a thickness of approximately 350 nm. Column electrodes 44 consist of chromium having a thickness of approximately 200 nm. Central portions 50 of the focusing ridges are formed with polyimide having a height of 40–70 nm. Focus metal coatings 52 consist of chromium having a thickness of 100–200 nm.

As with baseplate 36, faceplate 68 is formed with glass typically having a thickness of approximately 1.1 mm. Black matrix 72 is a photo-patternable material such as black chrome, opaque polyimide, or black frit of greater thickness than that of phosphor portions 70. The thickness of black matrix 72 is typically 20–100 μm. Light-reflective anode layer 74 consists of aluminum having a thickness of 20–60 nm.

Spacer walls 78 typically have a height of approximately 1.25 mm and a thickness of approximately 55 μm. Walls 78 are typically formed with resistive ceramic. Thirty pixels 34 are typically situated between adjacent spacer walls 78. Perimeter wall 24, whose height is approximately the same as that of spacer walls 70, consists of ceramic having a thickness of approximately 1.25 mm. Aside from PCB 56, the flat-panel CRT display in FIGS. 1 and 2 is approximately 3.5 mm thick.

The flat-panel CRT display of FIGS. 1 and 2 operates in the following manner. In each pixel $\mathbf{34}_{ij}$ phosphor portion 70 situated opposite column electrode $\mathbf{44}_{Rj}$ emits red light when struck by electrons. Phosphor portions 70 situated opposite column electrodes $\mathbf{44}_{Gj}$ and $\mathbf{44}_{Bj}$ similarly respectively emit green and blue light upon being struck by electrons.

Anode layer 74 is maintained at a high positive voltage—typically 4,000–8,000 volts—relative to both row electrodes 38 and column electrodes 44. Driver ICs 62 and 66 control electrodes 38 and 44 in such a way that a positive voltage on the order of 20–60 volts can be selectively applied between each column electrode $\mathbf{44}_{Rj}$, $\mathbf{44}_{Bj}$, or $\mathbf{44}_{Bj}$ and each row electrode $\mathbf{38}_i$. When this occurs, column electrode $\mathbf{44}_{Rj}$, $\mathbf{44}_{Gj}$, or $\mathbf{44}_{Bj}$ extracts electrons from electron emitters 48 situated at the selected intersection of row electrode $\mathbf{38}_i$ and column electrode $\mathbf{44}_{Rj}$, $\mathbf{44}_{Gj}$, or $\mathbf{44}_{Bj}$. Using focusing ridges 50/52 to control the electron trajectories, anode 74 attracts the emitted electrons toward phosphor portion 70 situated opposite the selected intersection of electrode $\mathbf{38}_i$ and electrode $\mathbf{44}_{Rj}$, $\mathbf{44}_{Gj}$, or $\mathbf{44}_{Bj}$. A large percentage of the electrons pass through anode 74 and hit selected phosphor portion 70. Upon being hit by the impinging electrons, phosphor portion 70 emits red, green, or blue light depending on whether selected column electrode 44 is electrode $\mathbf{44}_{Rj}$, $\mathbf{44}_{Gj}$, or $\mathbf{44}_{Bj}$.

To facilitate showing how a portion of plate structure 20 is converted into a baseplate structure of smaller active area, FIG. 3 illustrates a simplified embodiment of baseplate structure 20 containing considerably more pixels 34 than in FIG. 1. In particular, baseplate structure 20 in FIG. 3 contains twenty-four pixels 34 arranged in four rows (M equals 4) and six columns (N equals 6). A pair of exemplary pixels $\mathbf{34}_{12}$ and $\mathbf{34}_{25}$ are depicted in dot-and-dash lines in FIG. 3.

Several simplifications have been made in baseplate structure 20 of FIG. 3 to make it easier to understand the yield-enhancing technique of the invention. Each combination of row electrode $\mathbf{38}_i$ and overlying resistive coating $\mathbf{40}_i$ in FIG. 1 is illustrated as a row electrode $\mathbf{80}_i$ in FIG. 3. Accordingly, structure 20 in FIG. 3 has four row electrodes $\mathbf{80}_1$–$\mathbf{80}_4$ (collectively "80"). Each combination of column electrode $\mathbf{44}_{Rj}$, $\mathbf{44}_{Gj}$, or $\mathbf{44}_{Bj}$, column electrode extensions $\mathbf{46}_{Rj}$, $\mathbf{46}_{Gj}$, or $\mathbf{46}_{Bj}$, and the overlying (unlabeled) resistive coatings in FIG. 1 is illustrated as column electrode $\mathbf{82}_{Rj}$, $\mathbf{82}_{Gj}$, or $\mathbf{82}_{Bj}$ in FIG. 3. Structure 20 in FIG. 3 thus has eighteen column electrodes $\mathbf{82}_{R1}$, $\mathbf{82}_{G1}$, $\mathbf{82}_{B1}$–$\mathbf{82}_{R6}$, $\mathbf{82}_{G6}$, and $82_{B6}$ (collectively "82"). Finally, only one edge fiducial $54_E$ is illustrated along each of the left-hand and right-hand edges of structure 20 in FIG. 3 rather than two fiducials $54_E$ as depicted in FIG. 1.

FIGS. 4.1–4.3 present three examples of a baseplate structure 84 created from a non-defective portion of baseplate structure 20 in FIG. 3. To indicate that an item in baseplate structure 84 is the remainder of a larger item in baseplate structure 20, the letter "A" has been inserted in the reference symbol used in FIGS. 4.1–4.3 to identify the smaller-sized item. For example, each of baseplate structures 84 has a unitary active area 32A smaller than active area 32 in baseplate structure 20. Item 36A is the remainder of baseplate 36. In each structure 84, a perimeter strip 86 of the material that forms electrodes 80 and 82 has been removed along the edge or edges where structure 20 has been cut to form structure 84. Shortened row electrodes 80A and shortened column electrodes 82A in each of FIGS. 4.1–4.3 are the respective remainders of electrodes 80 and 82.

FIG. 4.1 illustrates an example in which the desired dimensions for active area 32A are one half the dimensions for active area 32 in both the row and column directions. In this example, one or more defects (are assumed to) have been found in the part of baseplate structure 20 outside the lower left-hand quadrant in FIG. 3. Baseplate structure 84 in FIG. 4.1 has thus been created from slightly more than the lower-left hand corner quadrant of structure 20 such that active area 32A is the lower left-hand quarter of active area 32. Structure 84 in FIG. 4.1 provides a landscape arrangement having the same active-area aspect ratio as structure 20.

To manufacture baseplate structure 84 in FIG. 4.1, baseplate structure 20 of FIG. 3 has been cut along a two-part piecewise-straight path running slightly to the right of the vertical center line and slightly above the horizontal center line in order to remove the defective material along with some of the adjoining material of structure 20. Row electrodes $80A_3$ and $80A_4$ in FIG. 4.1 are the remainders of row electrodes $80_3$ and $80_4$ in FIG. 3. Column electrodes $82A_{R1}$–$82A_{B3}$ are the remainder of column electrodes 82. Portions of electrodes 80 and 82 have also been removed at the horizontally and vertically extending portions of perimeter strip 86 in FIG. 4.1.

Baseplate structure 84 in FIG. 4.1 has three fiducials 54. Due to the way in which structure 84 is created in FIG. 4, lower left-hand corner fiducial $54_C$ of baseplate structure 20 is present in the lower left-hand corner of structure 84. Two edge fiducials $54_E$, previously located along the lower and left-hand edges of structure 20 in FIG. 3, are now at opposite corners of structure 84 in FIG. 4.1. There is no fiducial in the upper right-hand corner of structure 84 in FIG. 4.1.

The alignment needed for assembling baseplate structure 84 to a suitable faceplate structure can normally be performed with two or three corner fiducials. Accordingly, the absence of a fiducial in the upper right-hand corner of structure 84 in FIG. 4.1 is generally acceptable. However, if desired, small portions of one or more of column electrodes 82 could be left in the upper right-hand corner of structure 84 in FIG. 4.1 to provide a fiducial there.

FIG. 4.2 depicts an example in which the desired row length of active area 32A is one half the row length of active area 32, with no change in the column length. In the example of FIG. 4.2, one or more defects have been found in the left half of baseplate structure 20 in FIG. 3. Consequently, baseplate structure 84 in FIG. 4.2 has been created from slightly more than the right half of structure 20 in such a way that active area 32A is the right half of active area 32. Structure 84 in FIG. 4.2 is in a portrait arrangement. Due to the manner in which fiducials 54 were originally configured in structure 20 of FIG. 3, structure 84 in FIG. 4.2 has either a corner fiducial $54_C$ or an edge fiducial $54_E$ at every corner.

The fabrication of baseplate structure 84 in FIG. 4.2 involves cutting baseplate structure 20 of FIG. 3 along a straight path running slightly to the left of the vertical center line to remove the defective material and adjoining material to the left of the cut. Row electrodes $80A_1$ –$80A_4$ in FIG. 4.2 are the remainders of row electrodes 80 in FIG. 3. Column electrodes $82_{R4}$–$82_{B6}$ remain intact in structure 84. The material of electrodes 80 and 82 has been removed at vertically extending strip 86 in FIG. 4.2.

FIG. 4.3 illustrates an example which is largely the reverse of the example shown in FIG. 4.2. The desired column length of active area 32A in FIG. 4.3 is one half the column length of active area 32, with no change in the row length. In the example of FIG. 4.3, one or more defects have been found in the lower half of baseplate structure 20 in FIG. 3. Baseplate structure 84 in FIG. 4.3 has thus been created from slightly more than the upper half of structure 20 such that active area 32A is the upper half of active area 32. Structure 84 in FIG. 4.3 is now in an extended landscape arrangement. A fiducial $54_C$ or $54_E$ is at every corner of structure 84 in FIG. 4.3.

To manufacture baseplate structure 84 in FIG. 4.3, baseplate structure 20 has been cut along a straight path running slightly below the horizontal center line to remove the defective material as well as adjoining material below the cut. Row electrodes $80_1$, and $80_2$ remain intact in structure 84. Column electrodes $82A_{R1}$–$82A_{B6}$ are the remainders of column electrodes 82. The material of electrodes 80 and 82 has also been removed at horizontally extending strip 86 in FIG. 4.3.

Figure 5A:
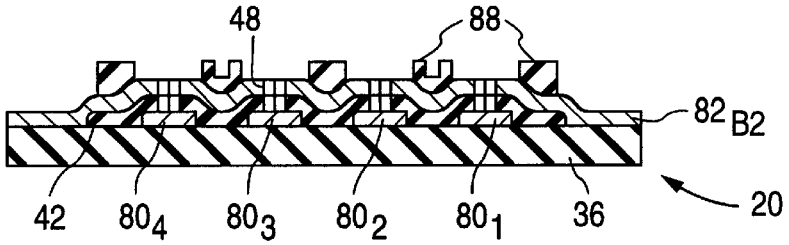
FIGS. 5*a*, 5*b*, 5*c*, 5*d*, and 5*e* are cross-sectional views representing steps in converting the baseplate structure of FIG. 3 into the baseplate structure of FIG. 4.1 and then into a matrix-addressable flat-panel CRT display according to the invention. The cross section of FIG. 5*a* is taken through plane 5*a*—5*a* in FIG. 3. The cross section of FIG. 5*d* is taken through plane 5*d*—5*d* in FIG. 4.1.

FIGS. 5*a*–5*e* (collectively "FIG. 5") illustrate how the simplified embodiment of baseplate structure 20 in FIG. 3 is converted into baseplate structure 84 of FIG. 4.1 and then into a matrix-addressable flat-panel CRT display. To simplify the illustration in FIG. 5, the combination of central focusing ridge portions 50 and overlying metallic coatings 52 are depicted simply as focusing ridges 88 in FIG. 5. FIG. 5*a* depicts a profile of baseplate structure 20 corresponding to the simplified layout of FIG. 3. After the fabrication of structure 20 is complete, structure 20 is tested to determine whether it has any defects.

Figure 5B:
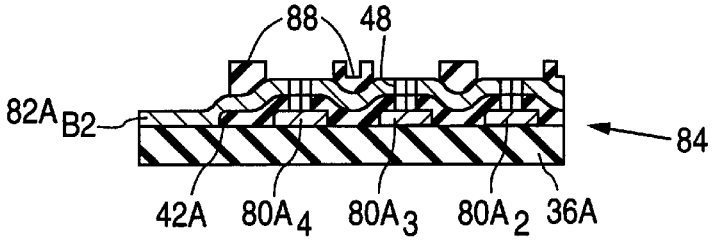

Assuming that one or more defects are found in structure 20 and that the quarter of active area 32 corresponding to active area 32A in FIG. 4.1 is non-defective, baseplate structure 20 is cut along the path described above in connection with FIG. 4.1. FIG. 5*b* illustrates resulting baseplate structure 84. Item 42A is the remainder of insulating layer 42.

During the cutting operation, a mask (not shown) is typical utilized to protect baseplate structure 20/84 from cutting debris. The mask can be a mechanical mask or can be formed with photoresist, later removed. The cutting operation can be done with a laser or by mechanical scribe and break.

Figure 5C:
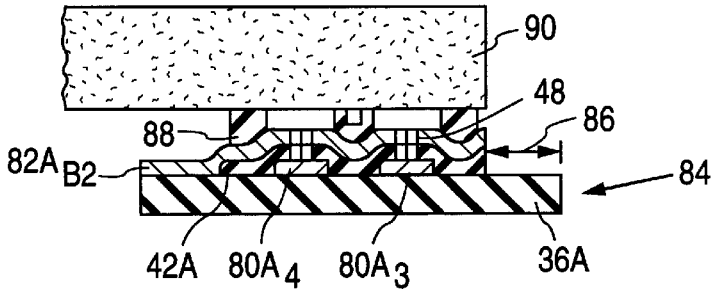
Figure 5D:
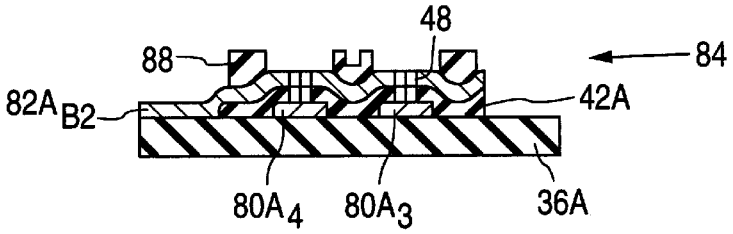

Next, a shadow mask 90 is placed over baseplate structure 84 as shown in FIG. 5*c*. Shadow mask 90 contacts (or nearly contacts) focusing ridges 88. Mask 90 has an opening at the location for perimeter strip 86. If a fiducial is desired in the upper right-hand corner of structure 84 in FIG. 4.1, mask 90 is configured so that a small portion of mask 90 is situated above the desired location for the fiducial. The small fiducial-defining portion of mask 90 is connected to the main part of mask 90 by a thin strip.

Using isotropic etching techniques such as reactive-ion etching, the portions of column electrodes 82/82A, insulating layer 42A, and row electrodes 80/80A at the location for perimeter strip 86 are sequentially removed. As a result, baseplate 36A is exposed at strip 86. Shadow mask 90 is removed to produce the structure of FIG. 5*d*.

Alternatively, only the portions of column electrodes 82/82A at strip 86 could be removed, leaving insulating layer 42A to cover the portions of row electrodes 80/80A at strip 86. In either case, a fiducial can be created from the portions of one or more of column electrodes 82/82A in the upper right-hand corner of baseplate structure 84 in FIG. 4.1 when mask 90 has a suitable blocking portion at the desired fiducial location.

As another alternative, the removal of perimeter strip 86 can be limited to removing only focusing ridges 88 because they extend relatively far from baseplate 36A. The portions of electrodes 38A and 44A at the location of strip 86 then remain in place. This alternative reduces the fabrication cost. If focusing ridges 88 are relatively short, the fabrication cost can be reduced further by deleting the perimeter-strip removal step.

Figure 5E:
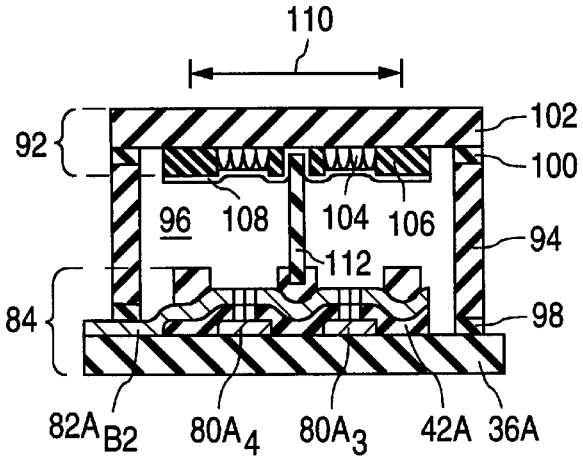

Regardless of how the removal (or non-removal) of perimeter strip 86 is handled, baseplate structure 84 is subsequently tested to determine whether it has any defects. Assuming that structure 84 is defect free, structure 84 is assembled to a suitable faceplate structure 92 through a perimeter sealing wall 94 to form a sealed enclosure 96. FIG. 5*e* illustrates the resultant matrix-addressable flat-panel CRT display. Items 98 and 100 are sealing glass at the edges of wall 94 along structures 84 and 92. As with sealed enclosure 26, the pressure in sealed enclosure 96 is typically set at vacuum level by removing air through a suitable pump port (not shown) situated near wall 94.

Faceplate structure 92 consists of a rectangular electrically insulating transparent faceplate 102, a pattern of eighteen phosphor portions 104, an opaque black matrix 106, and a thin metallic layer 108 that serves as the display anode. Components 102–108 are arranged the same as components 68–74 in faceplate structure 22 of FIG. 2. Arrow 110 in FIG. 5*e* indicate the active display area at faceplate 102. Active display area 110, which has substantially the same dimensions as active area 32A, is approximately one quarter of active display area 76 in the flat-panel CRT display created from baseplate structure 20 in FIG. 2. Item 112 is one of a plurality of spacer walls, analogous to spacer walls 78 in the CRT display of FIG. 2, which maintain a fixed spacing between baseplate structure 84 and faceplate structure 92.

A PCB (not shown), a pair of row and column tab connectors (not shown), and a pair of row and column driver ICs (not shown) respectively corresponding to PCB 56, tab connectors 60 and 64, and driver ICs 62 and 66 in the CRT display of FIG. 2 are subsequently added to the CRT display of FIG. 5*e* to provide the matrix-addressing capability. The CRT display of FIG. 5*e* then operates in the same way as the display of FIG. 2.

Alternatively, the voltages on electrodes 80 and 82 can be controlled by a mechanism that does not involve a PCB bonded to the exterior surface of baseplate 36A. Either of the alternative electrode voltage-control mechanisms described above for the CRT display of FIG. 2 can, for example, be utilized in the reduced-size display of FIG. 5*e*.

Instead of accessing row electrodes 80/80A and column electrodes 82/82A along the interior surface of baseplate 36/36A by having electrodes 80/80A and 82/82A pass below perimeter wall 24/94, both row electrodes 80/80A and column electrodes 82/82A can be accessed long the exterior surface of baseplate 36/36A by providing conductively filled vias in baseplate 36/36A. Baseplate structure 84 can then be created from an interior portion of baseplate structure 20—i.e., a portion of structure 20 spaced apart from its lateral perimeter—as well as from a portion of structure 20 along its lateral perimeter. This provides a further improvement in the manufacturing yield.

Figure 6:
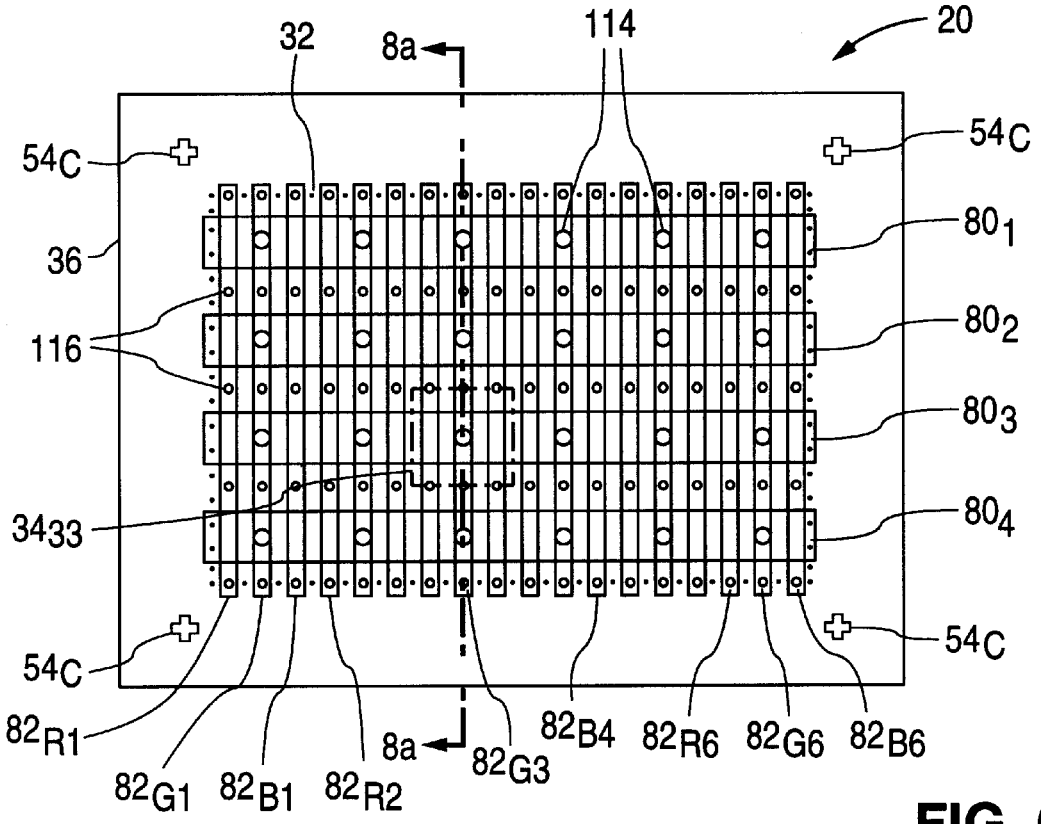
FIG. 6 is a simplified layout view of part of another baseplate structure in accordance with the invention.
Figure 7:
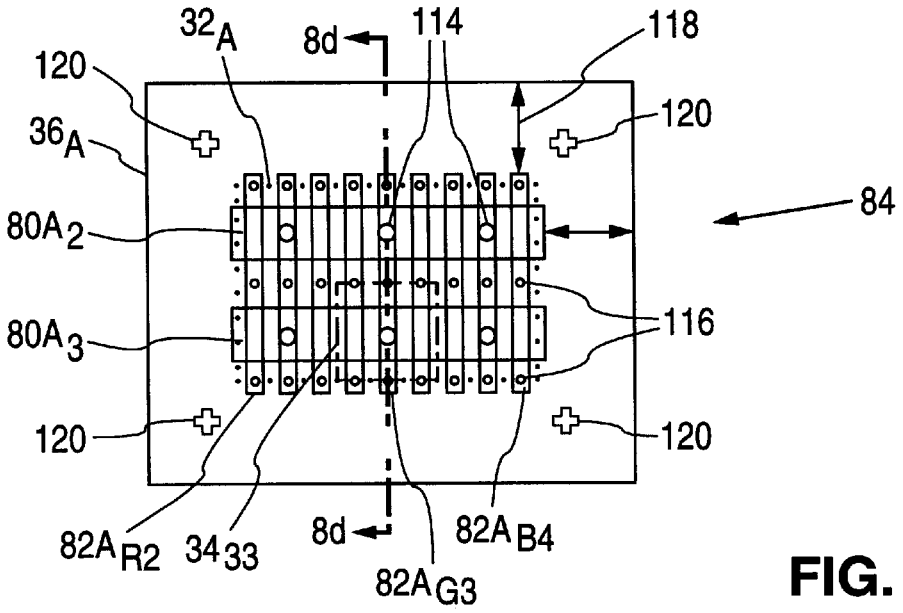
FIG. 7 is a simplified layout view of part of a baseplate structure creatable from the baseplate structure of FIG. 6 in accordance with the invention.

FIGS. 6 and 7 illustrate how the invention is implemented using conductively filled vias to access row electrodes 80/80A and column electrodes 82/82A from the exterior surface of baseplate 36/36A. An exemplary pixel $\mathbf{34}_{33}$ is shown in both of FIGS. 6 and 7.

FIG. 6 presents an embodiment of baseplate structure 20 generally analogous to that of FIG. 3 except that row electrodes 80 and column electrodes 82 are respectively accessed through conductively filled row vias 114 and conductively filled column vias 116 provided in baseplate 36. Conductively filled vias (or via plugs, 114 and 116 consist of suitable metal. Conductively filled row vias 114 are distributed along the length of each row electrode 80. Conductively filled column vias 116 are likewise distributed along the length of each column electrode 82. Because column electrodes 82 overlie row electrodes 80, conductively filled column vias 116 are provided through baseplate 36 and insulating layer 42 at locations to the sides of row electrodes 80.

In FIG. 6, one row via plug 114 is provided for each pixel $\mathbf{34}_{ij}$ in each row i, while one column via plug 116 is provided between each pair of pixels $\mathbf{34}_{ij}$ in each column j. However, via plugs 114 and 116 can be, and typically are, more widely spaced apart.

There is no need for electrodes 80 and 82 to pass below perimeter wall 24 when electrodes 80 and 82 are accessed through via plugs 112 and 114. Accordingly, electrodes 80 and 82 are terminated before reaching the intended location of wall 24 in baseplate structure 20 of FIG. 6. Inasmuch as edge fiducials ($\mathbf{54}_E$) provided near the perimeter of baseplate structure 20 are not useful when reduced-size baseplate structure $\mathbf{36}_A$ in baseplate structure 84 consists of an internal portion of baseplate 36, no edge fiducials are shown in FIG. 6.

FIG. 7 presents an embodiment of reduced-size baseplate structure 84 in which structure 84 has been created from an internal portion of original baseplate structure 20. One or more defects (are assumed to) have been found in the portion of original baseplate structure 20 outside reduced-size active area 32A in FIG. 7. Active area 32A in FIG. 7 has the same pixel dimensions as active area 32A in FIG. 4.1 so that reduced-size baseplate structure 84 in FIG. 7 provides the same active-area aspect ratio as original baseplate structure 20. Alternatively, reduced-size active area 32A could have different pixel dimensions and could even include one or more portions of the perimeter of original active area 32.

As in baseplate structure 20 of FIG. 6, there is no need for electrodes 80A and 82A in baseplate structure 84 of FIG. 7 to pass below the perimeter wall (94). A perimeter strip 118 of electrodes 80A and 82A has thus been removed along the perimeter of structure 84. Perimeter strip 118 is sufficiently wide that electrodes 80A and 82A do not reach the perimeter wall location. Four corner fiducials 120 have been furnished inside the intended location for the perimeter wall.

Figure 8A:
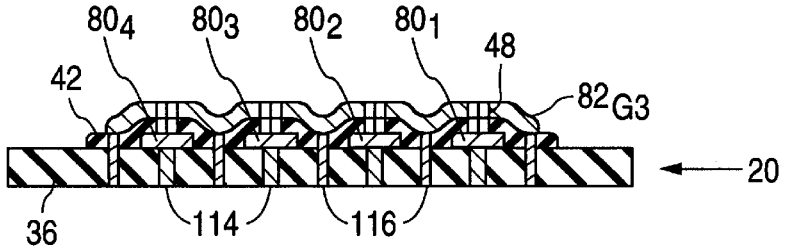
FIGS. 8*a*, 8*b*, 8*c*, 8*d*, and 8*e* are cross-sectional views representing steps in converting the baseplate structure of FIG. 6 into the baseplate structure of FIG. 7 and then into a matrix-addressable flat-panel CRT display according to the invention. The cross section of FIG. 8*a* is taken through plane 8*a*—8*a* in FIG. 6. The cross section of FIG. 8*d* is taken through plane 8*d*—8*d* in FIG. 7.

FIGS. 8*a*–8*e* (collectively "FIG. 8") depict how the embodiment of baseplate structure 20 in FIG. 6 is converted into baseplate structure 84 of FIG. 7 and then into a matrix-addressable flat-panel CRT display. To simplify the illustration, no focusing ridges (88) are shown in FIG. 8. FIG. 8*a* illustrates a profile of baseplate structure 20 corresponding to the layout of FIG. 6. At the stage shown in FIG. 8*a*, vias have been etched through baseplate 36 and filled with via metal to form via plugs 114 and 116. Subsequent to the via-plug formation, baseplate structure 20 has been tested and found to have one or more defects outside reduced-size active area 32A.

Figure 8B:
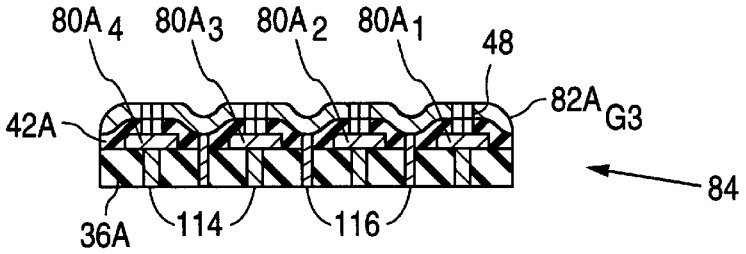

Baseplate structure 20 is cut along a rectangular path to produce reduced-size baseplate structure 84 as shown in FIG. 8*b*. A mask (not shown) is normally used to protect structure 20/84 during the cutting process.

Figure 8C:
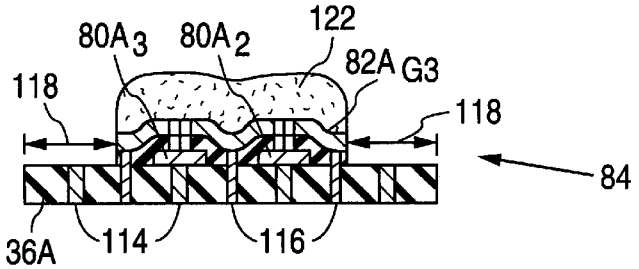
Figure 8D:
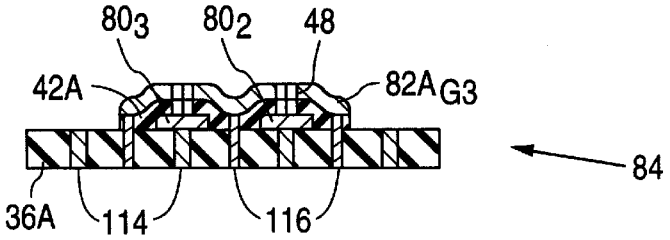

A mask 122—e.g., photoresist—having an open space above the location for perimeter strip 118 is furnished over the top of the structure as shown in FIG. 8*c*. Using anisotropic etching techniques, the exposed portions of column electrodes 82A, insulating layer 42A, and row electrodes 80A are removed. FIG. 8*d* illustrates baseplate structure 84 after the removal of mask 122.

At some point in going from the stage shown in FIG. 8*b* to the stage shown in FIG. 8*d*, fiducials 120 are provided at the corners of baseplate structure 84. Various etching and/or deposition techniques can be employed to create corner fiducials 120. For example, fiducials 120 may be formed by configuring mask 122 in such a way that fiducials 120 are created from parts of column electrodes 82A during the etching to remove perimeter strip 118. Taking note of the fact that focusing ridges 50/52 (labelled as items 88 in FIG. 5 but not shown in FIG. 8) are configured in a crossing pattern, corner fiducials 120 can be created by configuring mask 122 so that fiducials 120 constitute cross-shaped portions of focusing ridges 50/52.

Alternatively, a focused ion beam can be used in an imaging mode to accurately align to the layout of electrodes 80A and 82A. If the alignment is performed after removing perimeter strip 118, a selective metal deposition is performed by ion-beam enhanced chemical vapor deposition to create corner fiducials 120. If the alignment is done before removing strip 118, a sputter etch can be performed to remove strip 118 but leave fiducials 120.

Figure 8E:
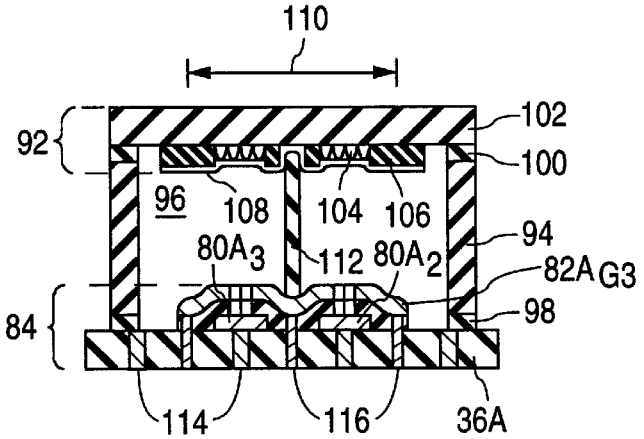

Baseplate structure 84 in FIG. 8*d* is tested to determine whether it has any defects. Assuming that none are found, structure 84 is assembled to faceplate structure 92 through perimeter wall 94 to produce a matrix-addressable flat-panel CRT display as shown in FIG. 8*e*. A printed circuit pattern, along with row and column driver ICs, is provided along the exterior surface of baseplate 36A to contact conductively filled vias 114 and 116 for driving electrodes 80A and 82A. Alternatively, via plugs 114 and 116 could be externally accessed through a suitable PCB bonded to the exterior surface of baseplate 36A and appropriately aligned to via plugs 114 and 116.

When row electrodes 80/80A and column electrodes 82/82A are accessed through metallic via plugs 112 and 114, baseplate 36/36A preferably consists of ceramic such as multi-layer ceramic created by laminating layers of green ceramic tape. Via plugs 114 and 116 can then be created according to well known techniques for creating and filling holes in ceramic. When baseplate 36/36A is formed with multi-layer ceramic, via plugs 114 and 116 can be electrically accessed by way of patterned metal layers provided between ceramic layers. Alternatively, techniques such as laser etching can be used to form the vias filled with plugs 114 and 116 when baseplate 36/36A consists of glass.

While the invention has been described with reference to particular embodiments, this description is solely for the purpose of illustration and is not to be construed as limiting the scope of the invention claimed below. For example, the invention can be employed with various kinds of flat-panel displays other than flat-panel CRT displays. Examples of other kinds of displays usable in the invention include liquid-crystal, electroluminescent, plasma, electrochromic, and electrophoretic matrix-addressable flat-panel displays. In addition to displays, the invention can be utilized with other types of generally plate-like matrix-addressable devices such as matrix-addressable sensors.

The matrix-addressable plate structures used in the invention could be curved rather than totally flat, provided that the radius of curvature of the plate structure is adequate for both the originally intended application and the actual application. In general, each plate structure can be cut along a path of arbitrary location to remove defects from the plate structure. Nonetheless, each plate structure could be configured so as to facilitate cutting along predefined paths. Depending on device size and defect location, two or more matrix-addressable plate structures can be created from one larger matrix-addressable plate structure.

Resistive coatings 40, along with the resistive coatings that overlie column electrode extensions 46, could be replaced with a blanket (continuous) resistive coating that overlies row electrodes 38 and electrode extensions 46. Masking, cutting, etching and deposition procedures besides those described above can be employed in the invention various modifications and applications may thus be made by those skilled in the art without departing from the true scope and spirit of the invention as defined in the appended claims.

We claim:

1. A method comprising the steps of:

determining that a defect exists in part of a first matrix-addressable plate structure of a unitary first active area; and removing the defective part of the first plate structure, along with selected adjoining material of the first plate structure, such that the remainder of the first plate structure comprises a second matrix-addressable plate structure of a second active area smaller than the first active area.

2. A method as in claim 1 further including the step of fabricating the first plate structure so that it comprises:

an electrically insulating plate;

a set of first electrodes extending over the plate generally in a first direction;

an electrically insulating layer situated over the first electrodes; and a set of second electrodes extending over the insulating layer above the first electrodes generally in a second direction different from the first direction such that the second electrodes cross the first electrodes.

3. A method as in claim 2 wherein both ends of each electrode in at least one of the sets of electrodes are externally accessible.

4. A method as in claim 2 wherein both ends of each electrode in both sets of electrodes are externally accessible.

5. A method as in claim 2 wherein each active area is generally rectangular.

6. A method as in claim 5 wherein one or two corners of the first plate structure are common to the second plate structure.

7. A method as in claim 2 further including the steps of:

forming vias through the plate; and introducing electrically conductive material into the vias to create electrical contacts to both sets of electrodes.

8. A method as in claim 7 wherein:

the insulating layer extends over portions of the plate not covered by the first electrodes; and the forming step entails extending part of the vias through the insulating layer to meet the second electrodes at locations not underlain by the first electrodes.

9. A method as in claim 7 wherein the second plate structure consists of a portion of the first plate structure spaced laterally apart from its perimeter.

10. A method as in claim 2 further including the step of substantially removing a perimeter strip of at least one of the two sets of electrodes along a perimeter portion of the second active area previous internal to the first active area.

11. A method as in claim 10 wherein the step of removing the strip includes leaving part of the strip to form at least one fiducial.

12. A method as in claim 10 further including the step of sealing the second plate structure to an additional plate structure to form a matrix-addressable device.

13. A method as in claim 12 wherein the sealing step is performed through a perimeter wall situated between the additional plate structure and the second plate structure.

14. A method as in claim 1 wherein, absent the defect, the first plate structure would be suitable for use in a matrix-addressable device of substantially the first active area.

15. A method as in claim 1 further including the step of incorporating the second plate structure into a matrix-addressable device of substantially the second active area.

16. A method as in claim 1 further including the step of incorporating the second plate structure into a matrix-addressable device of an active area greater than the second active area such that the second active area constitutes part of the active area of the device.

17. A method as in claim 1 further including the step of incorporating the second plate structure into a matrix-addressable flat-panel display.

18. A method as in claim 13 wherein the flat-panel display is of the cathode-ray tube type.

19. A method as in claim 1 wherein:

each active area is generally rectangular;

a quartet of first fiducials are situated outside the first active area in the first plate structure, each first fiducial located near a different corner of the first active area; and a pair of second fiducials are situated outside the first active area close to opposite sides of the first active area, at least one of the second fiducials being part of the second plate structure.

20. A method as in claim 1 wherein the removing step entails cutting the first plate structure along a path of arbitrary location in the first active area.

21. A method comprising the steps of:

providing a plurality of first matrix-addressable plate structures of a unitary first active area;

testing the first plate structures to determine whether any of them are defective and to identify each so-determined defective part of each defective first plate structure;

converting at least one non-defective first plate structure into a corresponding matrix-addressable device of substantially the first active area; and removing each defective part of each defective first plate structure, along with selected adjoining material of that defective first plate structure, such that the remainder of each defective first plate structure comprises a second matrix-addressable plate structure of a second active area smaller than the first active area.

22. A method as in claim 21 further including the steps of:

testing the second plate structures to determine whether any of them is defective; and converting at least one non-defective second plate structure into a second matrix-addressable device.

23. A method as in claim 22 wherein the second matrix-addressable device is of substantially the second active area.

24. A method as in claim 22 further including the step of joining at least two non-defective second plate structures to form the second matrix-addressable device at an active area greater than the first active area.

* * * * *